US005213512A

United States Patent [19]

Campbell et al.

[11] Patent Number: 5,213,512

[45] Date of Patent: May 25, 1993

[54] PLCC SOCKET MATEABLE CONNECTION

[75] Inventors: Ronald L. Campbell, Tustin; Douglas E. Riddle, Corona, both of Calif.

[73] Assignee: Hughes Aircraft Company, Los Angeles, Calif.

[21] Appl. No.: 919,463

[22] Filed: Jul. 24, 1992

[51] Int. Cl.[5] ..... H01R 9/09

[52] U.S. Cl. ..... 439/67; 439/74; 439/77; 439/493

[58] Field of Search ..... 439/67, 68, 74, 75, 439/77, 329, 330, 493

[56] References Cited

U.S. PATENT DOCUMENTS

| | | | |
|---|---|---|---|
| 4,716,500 | 12/1987 | Payne | 439/67 |
| 4,913,656 | 4/1990 | Gordon et al. | 439/67 |
| 4,917,613 | 4/1990 | Kabadi | 439/67 |
| 4,969,828 | 11/1990 | Bright et al. | 439/493 |
| 4,997,377 | 3/1991 | Goto et al. | 439/67 |
| 5,057,023 | 10/1991 | Kabadi et al. | 439/67 |

*Primary Examiner*—Paula A. Bradley

*Attorney, Agent, or Firm*—Terje Gudmestad; Wanda K. Denson-Low

[57] ABSTRACT

An electrical connector device (10) is provided in which a first member (15) of dielectric material defines a four-sided recess having a bottom wall (20) and side walls (16), and a second member (24) of dielectric material which can fit inside the recess with its edges (25) spaced a predetermined distance from the side walls (16) of the first member (15). Tab portions (31, 32, 44, 45) of one or more flexible circuits (11, 12) are bent around the side walls (16) of the first member (15) and frictionally held between the wall (16) of the first member (15) and the edge (25) of the second member (24). Exposed conductors (29, 49) of the flexible circuit (11, 12) on the outside of the wall (16) can mate with conductors (75) in a socket connector (13). Alignment means (19, 26, 73) are provided to align the flexible circuits (11, 12) with the members (15, 24) of dielectric material and to align the latter two members and frictionally hold them together.

13 Claims, 4 Drawing Sheets

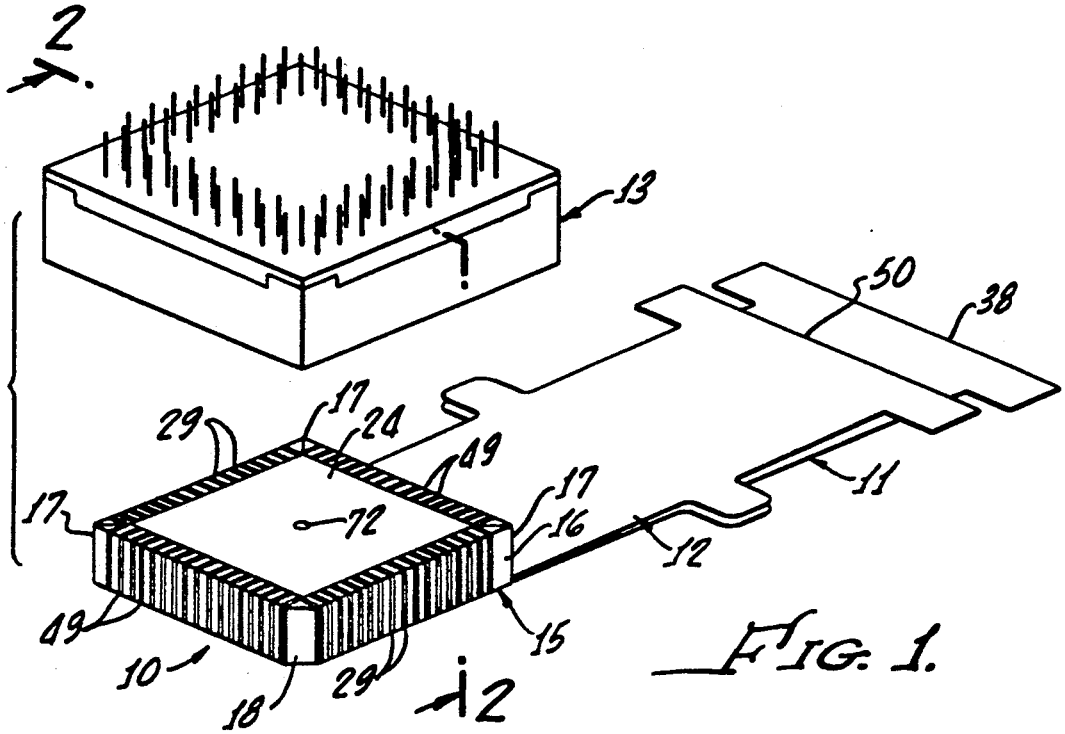
FIG. 1.
FIG. 2.
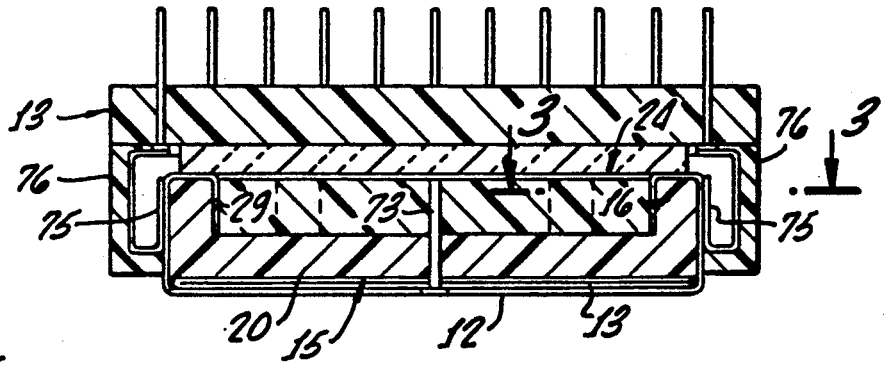
FIG. 3
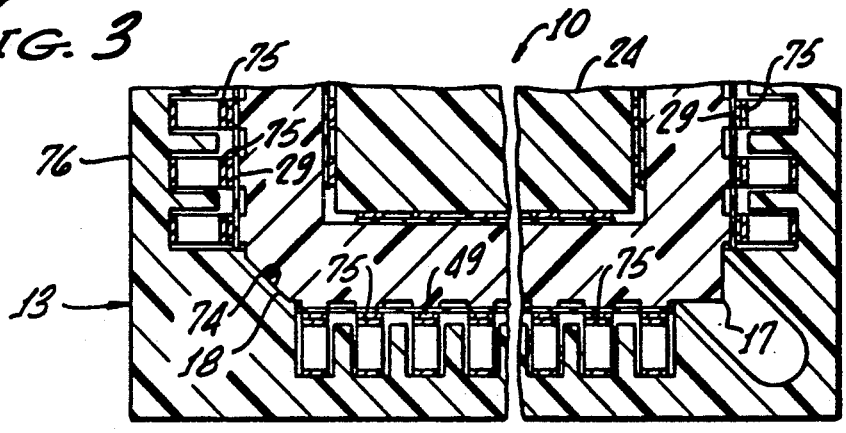

PLCC SOCKET MATEABLE CONNECTION

BACKGROUND OF THE INVENTION

1. Field of the Invention

This invention pertains to electrical connectors, and in particular to a connector for interconnecting flexible circuits with IC chip adapters.

2. Description of Related Art

In enhancing the data processing capacity of computers, it is necessary to include a large number of integrated circuit chips in the electronic package. Multiple chip packages require flexible jumper cables to interconnect boards in the IC chips. In the past there has been provided no low cost, easily used connector arrangement to interconnect the jumper cables and the IC chips.

SUMMARY OF THE INVENTION

The present invention provides a connector of a type entirely lacking in the prior art allowing interconnections between IC chips and the rigid printed wiring boards of an electronic package. The connector is low in manufacturing cost, easily made and assembled, and requires no adhesive or soldering in the connection of a flexible circuit to an IC chip adapter.

The present invention makes use of one or more flexible circuits which are clamped by two simple plastic members in a manner such that exposed conductors on the flexible circuits can engage the conductors of a conventional PLCC socket connector. One of the plastic members includes a base surface bounded by a rectangular peripheral wall. The second plastic member, which is substantially flat, fits within the recess defined by the peripheral wall and engages the base surface. Alignment pins projecting from the base wall are received in openings in the second member which positions the edge surface of the second member a predetermined distance from the inner surface of the peripheral wall around the recess of the first member. There is an interference fit between the pins and the openings so that this also retains the second member in the first.

Prior to joining the two plastic members of the connector together, a flexible circuit is provided with two oppositely projecting side tabs at one end where the conductors are exposed. These tabs are bent upwardly and inwardly so that they extend over the outer surfaces of two opposed portions of the peripheral wall. The ends of the tabs of the flexible circuit extend down along the inner surfaces of the peripheral wall. When the second member of the connector is forced into the first over the aligning pins, it causes the ends of the flexible circuit tabs to be frictionally gripped and clamped between the side edges of the second member and the opposed walls of the first. This retains the flexible circuit to the connector assembly.

The exposed conductors then are positioned over ridges on the outer surface of the peripheral wall of the first connector member. When the assembly is then introduced into the socket of a PLCC socket connector, the conductors on the flexible circuit bear against the conductors along the inner edge of the PLCC connector, making an electrical connection.

Two flexible circuits may be connected, in which event the second is provided with a laterally projecting portion which is doubled back over the main portion of the flexible circuit and bent at its edges to provide parts that can fit over the wall of the first member of the connector and be clamped by the second connector member in the same manner as the end portions of the first flexible circuit.

BRIEF DESCRIPTION OF THE DRAWINGS

FIG. 1 is a prospective view of the connector of this invention, along with a socket connector to which it is to be connected;

FIG. 2 is an enlarged sectional view taken along line 2—2 of FIG. 1;

FIG. 3 is a sectional view taken along line 3—3 of FIG. 2;

DESCRIPTION OF THE PREFERRED EMBODIMENTS

The connector 10 of this invention, as shown in FIG. 1, is to connect the conductors of two flexible circuits 11 and 12 with a standard PLCC socket connector 13.

Figure 4:
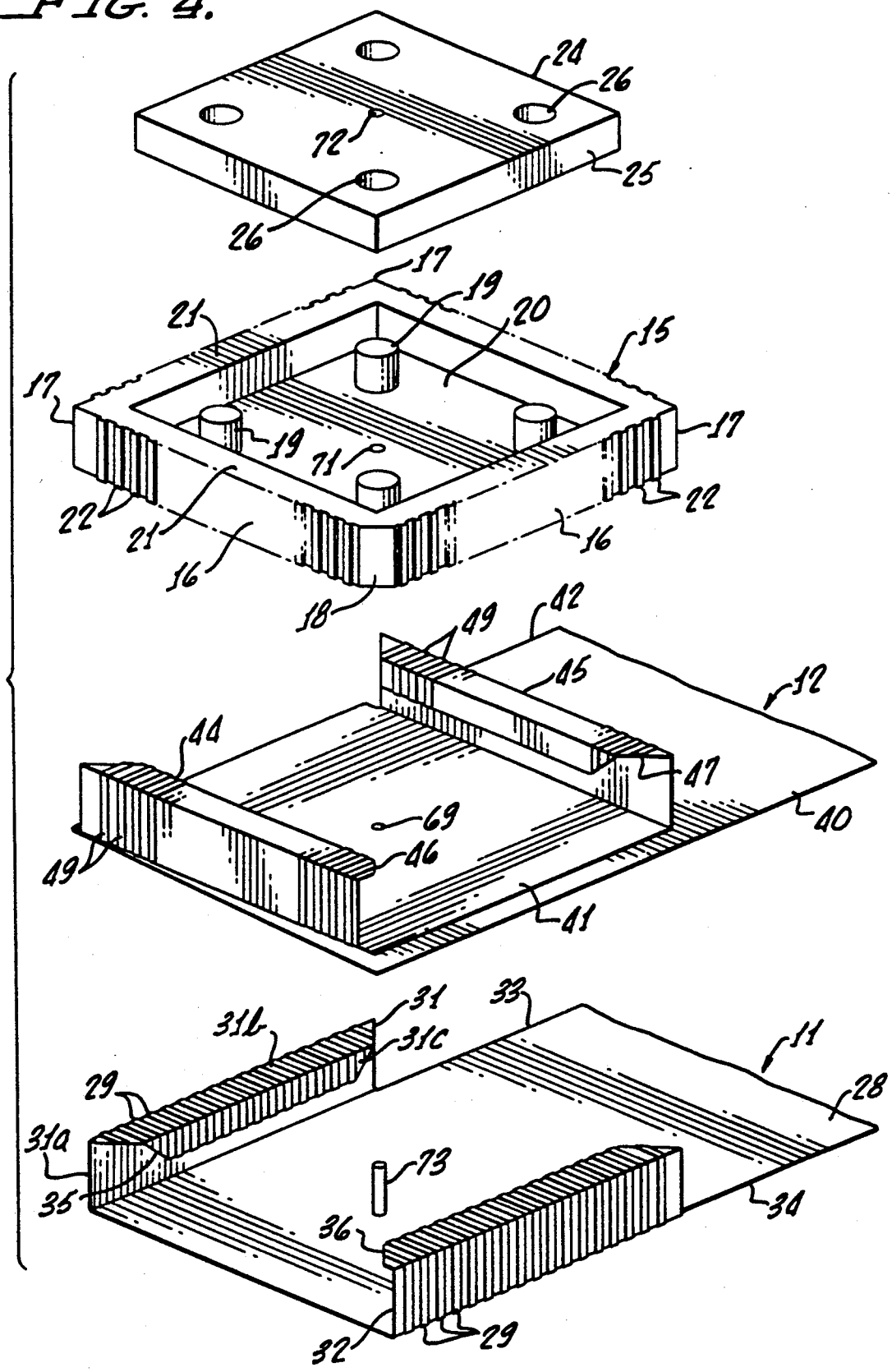
FIG. 4 is an enlarged exploded perspective view of the components of the connector.

The connector 10 includes a shallow plastic member 15, as seen in FIG. 4, having four sidewalls 16 arranged in a generally square pattern. The interconnections of the sidewalls 16 provide three exterior corners 17 that meet at right angles. The fourth exterior corner 18 is defined by a beveled surface. Within the walls 16 are four pins 19 which project upwardly at 90 degrees from a bottom wall 20 that interconnects the sidewalls 16 at their lower edges. The outer ends of the pins 19 are in the same plane as the top edges 21 of the walls 16.

A series of equally spaced ridges 22 extends the height of each of the sidewalls 16, the ridges being perpendicular to the upper and lower edges of the walls. The ridges 22 correspond in number and spacing to the contact fingers within the PLCC connector 13, as explained below.

The connector 10 also includes a square, flat plastic plate 24 which is of the same thickness as the height of the walls 16 above the bottom wall 20 of the member 15. The opposite side edges 25 of the member 24 are spaced apart a distance slightly less than spacing between the inner surfaces of opposite walls 16 of the member 15. Openings 26 are provided in the member 24 and dimensioned to receive the pins 19 with a light press fit.

Figure 5:
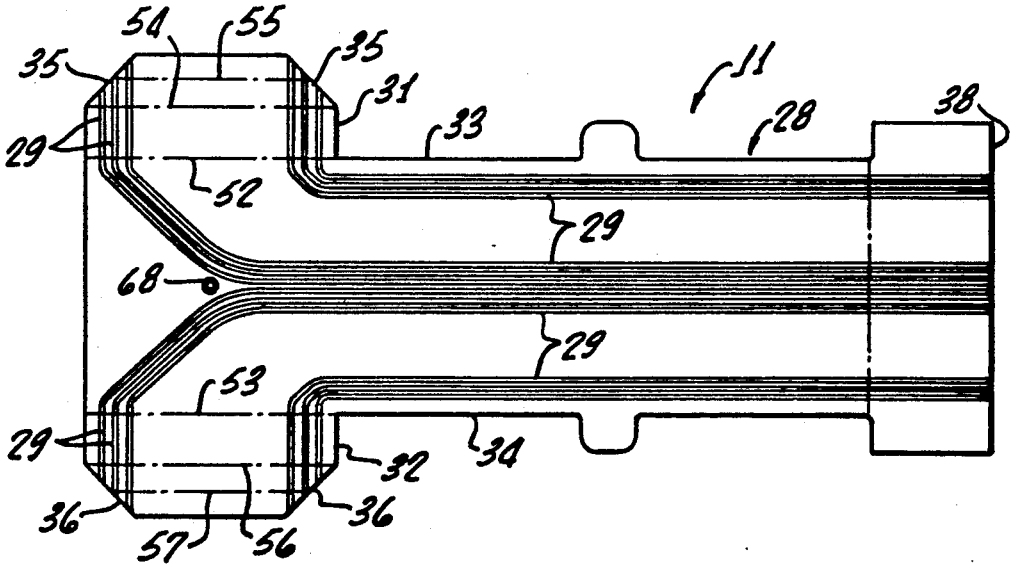
FIG. 5 is a plan view of one of the flexible circuits used with the connector.
Figure 7:
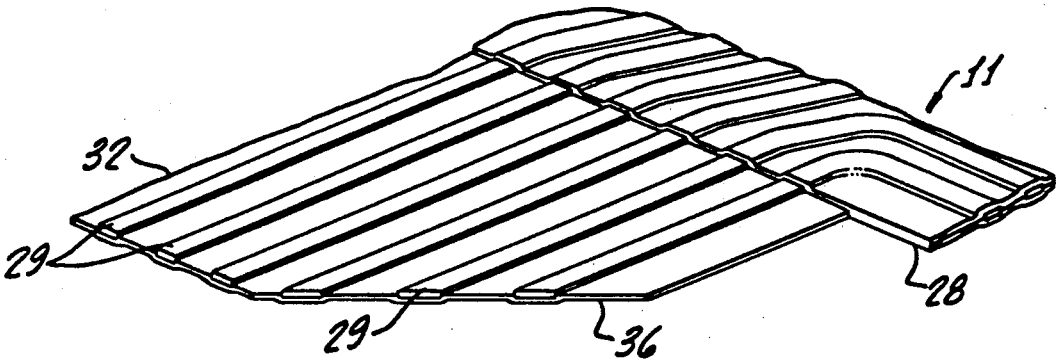
FIG. 7 is an enlarged fragmentary perspective view of one of the flexible circuits.
Figure 8:
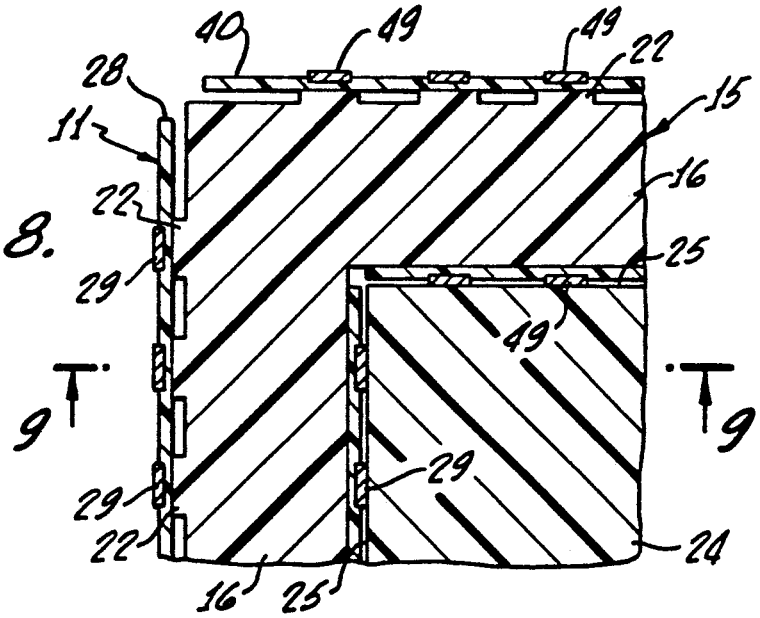
FIG. 8 is an enlarged fragmentary sectional view of the connector with the flexible circuits attached.
Figure 9:
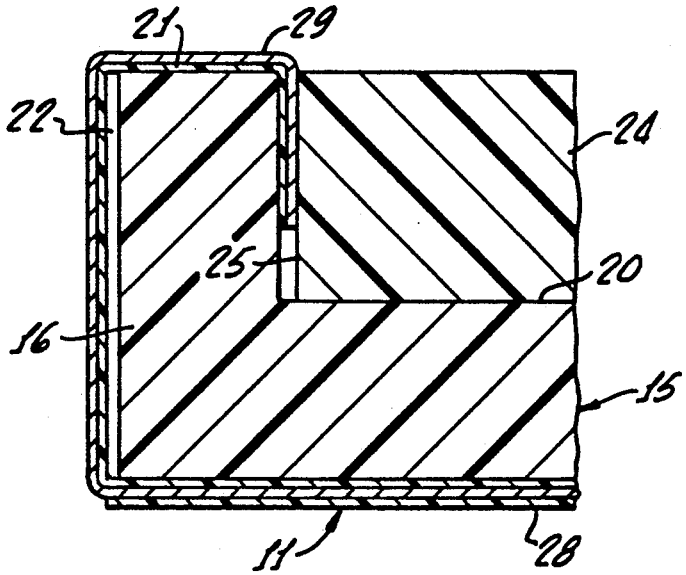
FIG. 9 is a sectional view taken along line 9—9 of FIG. 8.

The flexible circuit 11, as seen in FIG. 5, includes a dielectric substrate 28 within which are embedded linear conductors 29. The substrate 28 is of elongated generally rectangular shape, but includes tabs 31 and 32 projecting from the two side edges 33 and 34 at one end of the substrate. The tabs 31 and 32 are rectangular in shape except for beveled outer corners 35 and 36, respectively.

The conductors 29 extend the length of the substrate 28, curving in two directions at one end to flare outwardly in two similar groups on either side onto the tabs 31 and 32. At the locations of the tabs 31 and 32, the conductors are perpendicular to the side edges 33 and 34 of the substrate 28. Also, at the location of the tabs 31 and 32, the conductors 29 are exposed on one side of the substrate 28. At other locations, the conductors 29 are buried within the substrate 28 except at the opposite end 38 of the substrate where similarly a length of the conductors 29 is exposed.

Figure 6:
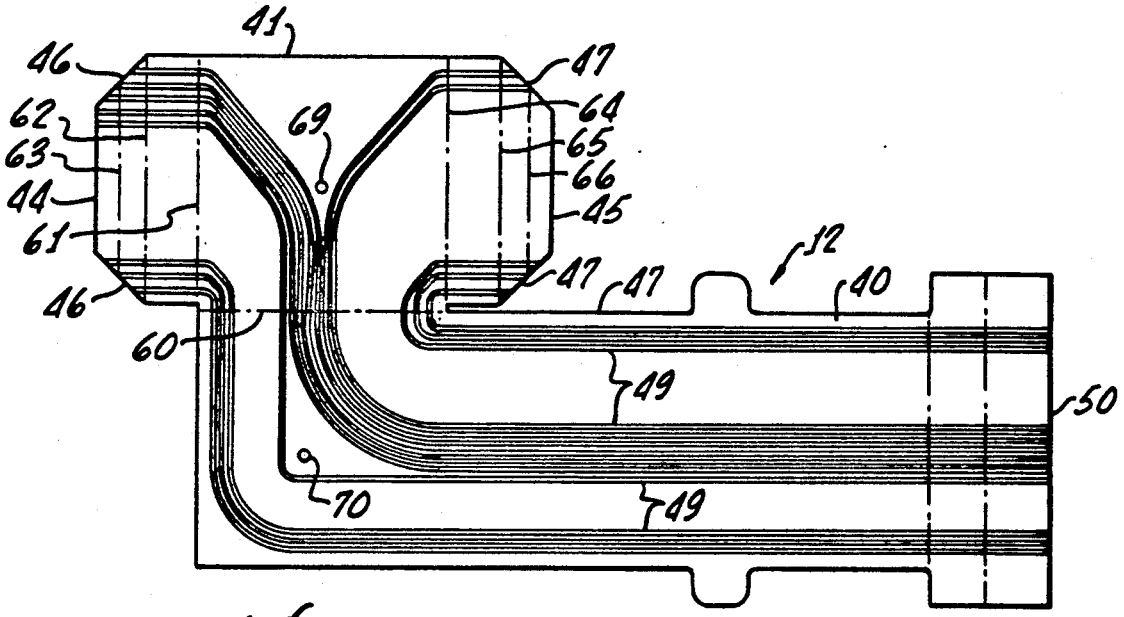
FIG. 6 is a plan view of the other flexible circuit.

The flexible circuit 12 (FIG. 6) includes a substrate 40 which is generally J-shaped, including an end section 41 which projects from one side edge 42 of the substrate. The end part 41 of the substrate 40 includes two oppositely projecting tabs 44 and 45 which are similar to the tabs 31 and 32 of the substrate 28. The tabs 44 and 45 include beveled corners 46 and 47. Conductors 49 extend along the substrate 40 from its opposite end 50 to the end section 41 and the tabs 44 and 45. The conductors 49 are parallel to the edge 42 at the tabs. The conductors 49 are exposed on one side of the substrate along the tabs 44 and 45, as well as at the opposite end 50.

The substrate 28 and conductors 29 are bent at 90 degree angles along the phantom lines 52 and 53 where the tabs 31 and 32 join the side edges 33 and 34. Two additional and parallel bends of 90 degrees are made along the phantom lines 54 and 55 on the outer portions of the tab 31. Similar 90 degree bends are made along the lines 56 and 57 on the outer portions of the tab 32. This provides the end portion of the flexible circuit 11 with the configuration shown in FIG. 2, where the tab 31 then has an upstanding portion 31*a*, a portion 31*b* at the outer end of the portion 31*a* which is parallel to the principal portion of the substrate 28, and an outer end part 31*c* which is parallel to the upstanding portion 31*a* but is shorter so that it does not reach the substrate beneath it. When this is done, the conductors 29 are exposed on the outside of the upstanding portion 31*a*. The other tab 32 is similarly configured.

A bend is made in the flexible circuit 12 along the phantom line 60 which forms a continuation of the side edge 42 of the substrate 40. This causes the end part 41 of the flexible circuit 12 to be doubled over the end of the principal portion of that flexible circuit. The tabs 44 and 45 are given 90 degree bends to assume a configuration similar to that of the bent tabs 31 and 32. This includes bends along parallel phantom lines 61, 62 and 63 for the tab 44 and similar bends along the parallel phantom lines 64, 65 and 66 for the tab 45. When the flexible circuit 12 is superimposed on the flexible circuit 11, the two bent tabs 44 and 45 then are at right angles to the bent tabs 31 and 32.

An opening 68 is provided through the substrate 28 intermediate the tabs 31 and 32. A similar opening 69 is formed in the substrate 40 between the tabs 44 and 45. The opening 69 is aligned with another opening 70 in the principal portion of the substrate 40 when the end part 41 is doubled over to the position of FIG. 2. There is also an opening 71 in the bottom wall 20 of the member 15 and another opening 72 through the center of the flat plate 24. These openings receive an alignment pin 73 which aligns the flexible circuits 11 and 12 with the connector components 15 and 24. The flexible circuits 11 and 12 are positioned together, with the circuit 12 being above the circuit 11. The tabs 31, 32, 44 and 45 then are in a square pattern. The connector member 15 is located over the two flexible circuits 11 and 12 and intermediate the tabs 31, 32, 44 and 45. If the tabs have been prebent to the configuration shown in FIG. 2, some unfolding will be necessary in order to admit the connector body 15 between the tabs.

With the connector body 15 positioned in that manner, the tabs 31, 32, 44 and 45 extend over the upper edges 21 of the straight walls 16 and down along the inside surfaces of the walls. The locations of the bends in the tabs are selected so that the connector member 15 at its walls 16 makes a close fit within the bent tabs. The alignment pin 73 assures that the exposed portions of the conductors 29 of the flexible circuit 11 and of the conductors 49 of the flexible circuit 12 are directly opposite from the ribs 22 on the walls 16 of the connector body 15.

The flat plate 24 then is introduced into the interior of the connector body 15, with a press fit being created between the pins 19 and the openings 26. The pins 19 align the plate 24 so that the inner portions of the tabs 31, 32, 44 and 45 that overlap the interiors of the walls 16 are pinched and frictionally held between the side edges 25 of the flat plate 24 and the walls 16. The conductors 29 and 49 are exposed along the outer surfaces of the walls 16. This completes the assembly of the connector and the flexible circuits so that the connector then is ready to mate with the socket PLCC connector 13.

The connector 10 fits within the socket of the PLCC connector 13, as shown in FIGS. 2 and 3. The beveled corner 18 on the member 15 is positioned at a beveled corner 74 within the PLCC connector which assures proper polarity when the connector 10 mates with the PLCC connector. Within the PLCC connector are conductors 75 spaced along its side wall 76. The conductors 75 in their free position incline toward the center of the socket. The conductors 75 are engaged and deflected by the exposed portions of the conductors 29 and 49 of the flexible circuits 11 and 12 that are opposite the ribs 22 on the outside of the walls 16. This provides an electrical connection between the conductors 29 and 49 of the connector 10 and the conductors 75 of the PLCC connector 13.

The connector 10 may be connected to only one flexible circuit rather than two, if desired.

The foregoing detailed description is to be clearly understood as given by way of illustration and example only, the spirit and scope of this invention being limited solely by the appended claims.

What is claimed is:

1. An electrical connector comprising a first member defining a recess adjacent which is a first wall having an outside surface, an inside surface and an edge surface between said inside and outside surfaces, a second member having a second wall, said second member being received within said recess with a predetermined clearance between said inside surface of said first wall and said second wall, and a flexible circuit having a plurality of exposed conductors at one end portion thereof, said end portion extending over said outside, edge and inside surfaces of said first wall and being engaged by said inside surface and said second wall so that it is frictionally held between said first and second walls, with said exposed conductors being opposite said outside surface and facing outwardly thereof, whereby said exposed conductors on the outside of said first wall can mate with conductors of a socket connector and said flexible circuit is attached to said first and second members.

2. A device as recited in claim 1 in which said first wall extends around the periphery of said recess.

3. A device as recited in claim 1 in which said first and second walls have straight segments, said end portion of said flexible circuit being so frictionally held between said straight segments.

4. A device as recited in claim 1 in which said first member includes a bottom wall, said first wall projecting upwardly from the periphery of said bottom wall, said second member engaging said bottom wall.

5. A device as recited in claim 4 including, in addition, friction means for holding said second member in said recess.

6. A device as recited in claim 5 in which for said friction means said first member includes at least one element projecting upwardly from said bottom wall and spaced from said first wall, said second member having an opening receiving said element with a force fit.

7. A device as recited in claim 6 in which for said element a plurality of pins are provided on said bottom wall, and said second member has a corresponding opening for each of said pins.

8. A device as recited in claim 4 in which said bottom wall is flat, and said second member includes a flat surface engaging said bottom wall.

9. A device as recited in claim 1 in which said conductors are linear, and in which said outer surface is provided with a plurality of ridges thereon, said exposed conductors being opposite from said ridges.

10. A device as recited in claim 1 in which said flexible circuit includes two opposite portions at said end portion thereof, said opposite portions extending over opposite parts of said first wall, both of said opposite portions being frictionally held between said first and second walls.

11. A device as recited in claim 10 including, in addition, a second flexible circuit having a laterally projecting part at one end, said projecting part being doubled over the adjacent portion of said second flexible circuit and having opposite portions having exposed conductors and extending over two additional opposite parts of said first wall and frictionally held between said first and second walls, whereby said exposed conductors of said second flexible circuit can mate with conductors of a socket connector and said second flexible circuit is attached to said first and second members.

12. An electrical connector comprising a first member of dielectric material having a substantially flat base wall and a sidewall projecting substantially perpendicularly therefrom and arranged in a rectangular pattern to provide an enclosed space defined by opposite wall segments, a second generally flat member of dielectric material having a rectangular peripheral edge, pin means projecting from said base wall, said second member being received within said enclosed space and said engaging said base wall, said second member having opening means therein receiving said pin means with an interference fit for holding said second member to said first member and aligning said second member so that said peripheral edge is spaced a predetermined distance from said sidewall, and a flexible circuit including a plurality of linear conductors in a substrate, said flexible circuit having two oppositely projecting tabs where said linear conductors are exposed, said first member being positioned with its base wall on said flexible circuit intermediate said tabs, said tabs being bent so as to extend over the outer surfaces of opposed wall segments with the ends of said tabs extending over the inner surfaces of said opposed wall segments and with the linear conductors thereof being exposed along said outer surfaces, said ends of said tabs being engaged and frictionally held between said opposed wall segments and said peripheral edge of said second member, whereby said flexible circuit is held to said first and second members and said exposed conductors can mate with conductors of a socket connector.

13. A device as recited in claim 12 including in addition a second flexible circuit including a plurality of linear conductors in a substrate, said second flexible circuit including a first part and a second part, said second part being doubled over said first part and including two oppositely projecting tabs where said linear conductors of said second flexible circuit are exposed, said tabs of said second flexible circuit being perpendicular to said tabs of said first mentioned flexible circuit, and extending over additional opposed wall segments with the ends of said tabs of said second flexible circuit being engaged and frictionally held between said additional opposed wall segments and said peripheral edge of said second member.

* * * * *